US008238561B2

(12) United States Patent
Jung et al.

(10) Patent No.: US 8,238,561 B2
(45) Date of Patent: Aug. 7, 2012

(54) METHOD FOR ENCODING AND DECODING MULTI-CHANNEL AUDIO SIGNAL AND APPARATUS THEREOF

(75) Inventors: Yang-Won Jung, Seoul (KR); Hee Suk Pang, Seoul (KR); Hyen-O Oh, Gyeonggi-do (KR); Dong Soo Kim, Seoul (KR); Jae Hyun Lim, Seoul (KR)

(73) Assignee: LG Electronics Inc., Seoul (KR)

( * ) Notice: Subject to any disclaimer, the term of this patent is extended or adjusted under 35 U.S.C. 154(b) by 475 days.

(21) Appl. No.: 12/091,921

(22) PCT Filed: Oct. 20, 2006

(86) PCT No.: PCT/KR2006/004286

§ 371 (c)(1),
(2), (4) Date: Jun. 25, 2008

(87) PCT Pub. No.: WO2007/049881

PCT Pub. Date: May 3, 2007

(65) Prior Publication Data

US 2008/0262854 A1 Oct. 23, 2008

Related U.S. Application Data

(60) Provisional application No. 60/730,033, filed on Oct. 26, 2005.

(30) Foreign Application Priority Data

Jul. 28, 2006 (KR) ..... 10-2006-0071754

(51) Int. Cl.
*H04R 5/00* (2006.01)

(52) U.S. Cl. ..... 381/22; 381/23; 381/119

(58) Field of Classification Search ..... 381/1, 17, 381/18, 22, 23, 119; 700/94
See application file for complete search history.

(56) References Cited

U.S. PATENT DOCUMENTS 5,682,461 A 10/1997 Silzle et al.
6,529,604 B1 * 3/2003 Park et al. ..... 381/22
6,774,820 B2 8/2004 Craven et al.

(Continued)

FOREIGN PATENT DOCUMENTS

WO 00/60746 10/2000

(Continued)

OTHER PUBLICATIONS

International Search Report in corresponding International Application No. PCT/KR2006/004286 dated Jan. 24, 2007, 4 pages. Beack, S. et al., "An Efficient Representation Method for ICLD with Robustness to Spectral Distortion", ETRI Journal, Jun. 2005, 4 pages.

(Continued)

*Primary Examiner* — Xu Mei
(74) *Attorney, Agent, or Firm* — Fish & Richardson P.C.

(57) ABSTRACT

Methods and apparatuses for encoding and decoding a multi-channel audio signal are provided. In the encoding method, spatial information that is calculated based on a multi-channel audio signal and a downmix signal is encoded, and additional configuration information is generated based on information that is selected from the encoded spatial information. The downmix signal is encoded, and then, a bitstream is generated by combining the encoded downmix signal with the encoded spatial information. Thereafter, the additional configuration information is inserted into the bitstream. Therefore, it is possible to configure an optimum bitstream according to the circumstances by retransmitting all or part of information included in a header.

12 Claims, 6 Drawing Sheets

U.S. PATENT DOCUMENTS

| | | | | |
|---|---|---|---|---|
| 7,006,636 | B2 * | 2/2006 | Baumgarte et al. | 381/17 |
| 7,394,903 | B2 * | 7/2008 | Herre et al. | 381/23 |
| 2002/0152072 | A1 * | 10/2002 | Den Brinker | 704/254 |
| 2005/0177360 | A1 | 8/2005 | Schuijers et al. | |
| 2006/0233380 | A1 * | 10/2006 | Holzer et al. | 381/23 |
| 2007/0009105 | A1 * | 1/2007 | Liebchen | 381/23 |

FOREIGN PATENT DOCUMENTS

| | | |
|---|---|---|
| WO | 03/090208 | 10/2003 |
| WO | WO2007042108 | 4/2007 |

OTHER PUBLICATIONS

Office Action, Chinese Appln. No. 200680039835.1, dated Sep. 29, 2011, 13 pages with English translation.

Breebaart Jeroen et al: "The Reference Model Architecture for MPEG Spatial Audio Coding", AES Convention 118; May 1, 2005, XP040507255.

Supplementary European Search Report for European Application No. EP06799359, dated Feb. 7, 2011, 7 pages.

* cited by examiner

[Fig. 1]
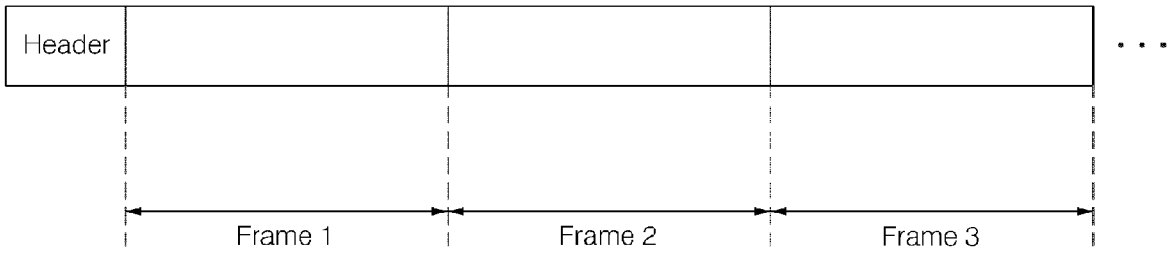

[Fig. 2]
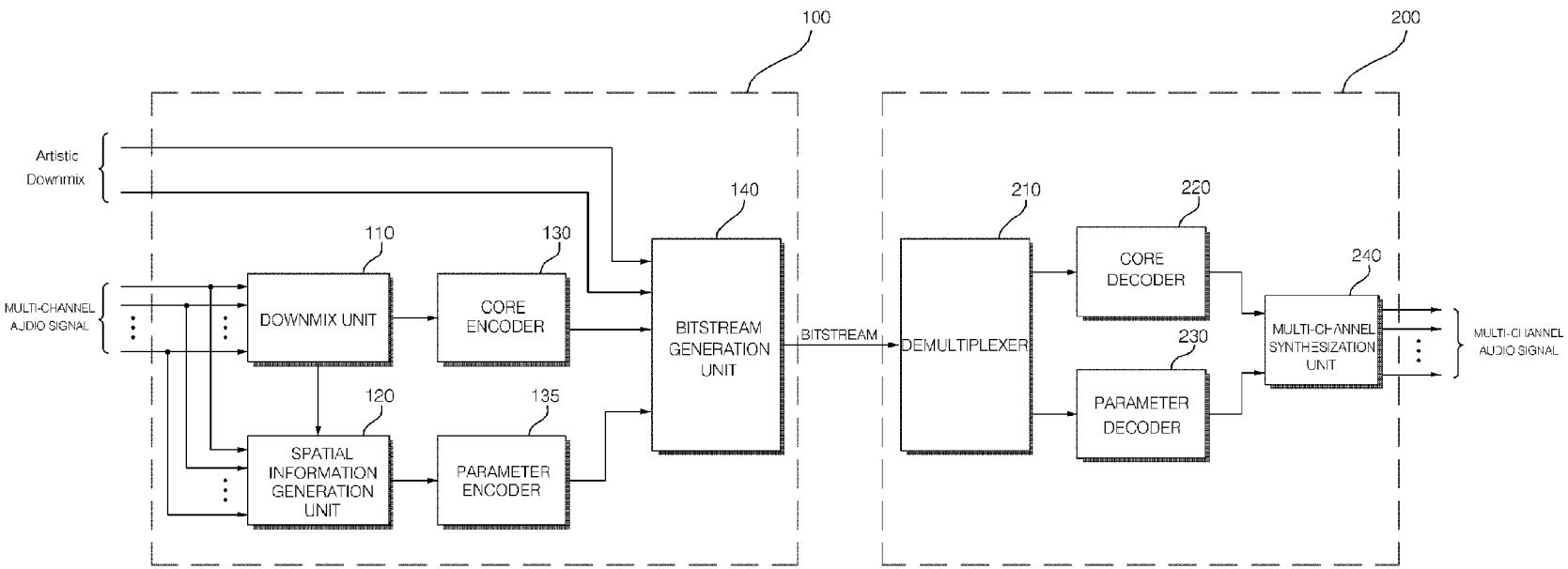

[Fig. 3]

Syntax of SpatialSpecificConfig()

| Syntax | No. of bits | Mnemonic |
|---|---|---|
| SpatialSpecificConfig() | | |
| { | | |
| **bsSamplingFrequencyIndex**; | **4** | **uimsbf** |
| if ( bsSamplingFrequencyIndex == 0xf ) { | | |
| **bsSamplingFrequency**; | **24** | **uimsbf** |
| } | | |
| **bsFrameLength**; | **7** | **uimsbf** |
| **bsFreqRes**; | **3** | **uimsbf** |
| **bsTreeConfig**; | **4** | **uimsbf** |
| **bsQuantMode**; | **3** | **uimsbf** |
| **bsOneIcc**; | **1** | **uimsbf** |
| **bsArbitraryDowmix**; | **1** | **uimsbf** |
| **bsFixedGainSur**; | **3** | **uimsbf** |
| **bsFixedGainLFE**; | **3** | **uimsbf** |
| **bsFixedGainDMX**; | **3** | **uimsbf** |
| **bsMatrixMode**; | **1** | **uimsbf** |
| **bsTempShapeConfig**; | **4** | **uimsbf** |
| **bsDecorrConfig**; | **4** | **uimsbf** |
| **bs3DaudioMode**; | **1** | **uimsbf** |
| for (i=0; i<numOttBoxes; i++) { | | Note 1 |
| OttConfig(i); | | |
| } | | |
| for (i=0; i<numTttBoxes; i++) { | | Note 1 |
| TttConfig(i); | | |
| } | | |
| if ((bsTempShapeConfig>=4) && (bsTempShapeConfig<8)) { | | |
| **bsEnvQuantMode** | **3** | **uimsbf** |
| } | | |
| if (bs3DaudioMode) { | | |
| **bs3DaudioHRTFset**; | **2** | **uimsbf** |
| if (bs3DaudioHRTFset==0) { | | |
| ParamHRTFset(); | | |
| } | | |
| } | | |
| SpatialExtensionConfig(); | | |
| } | | |

[Fig. 4]

Syntax of SpatialFrame()

| Syntax | No. of bits | Mnemonic |
|---|---|---|
| SpatialFrame() | | |
| { | | |
| FramingInfo(); | | |
| **bsIndependencyFlag**; | **1** | **uimsbf** |
| OttData(); | | |
| TttData(); | | |
| SmgData(); | | |
| TempShapeData(); | | |
| if (bsArbitraryDownmix != 0) { | | |
| ArbitraryDownmixData(); | | |
| } | | |
| SpatialExtensionFrame(); | | |
| } | | |

[Fig. 5]
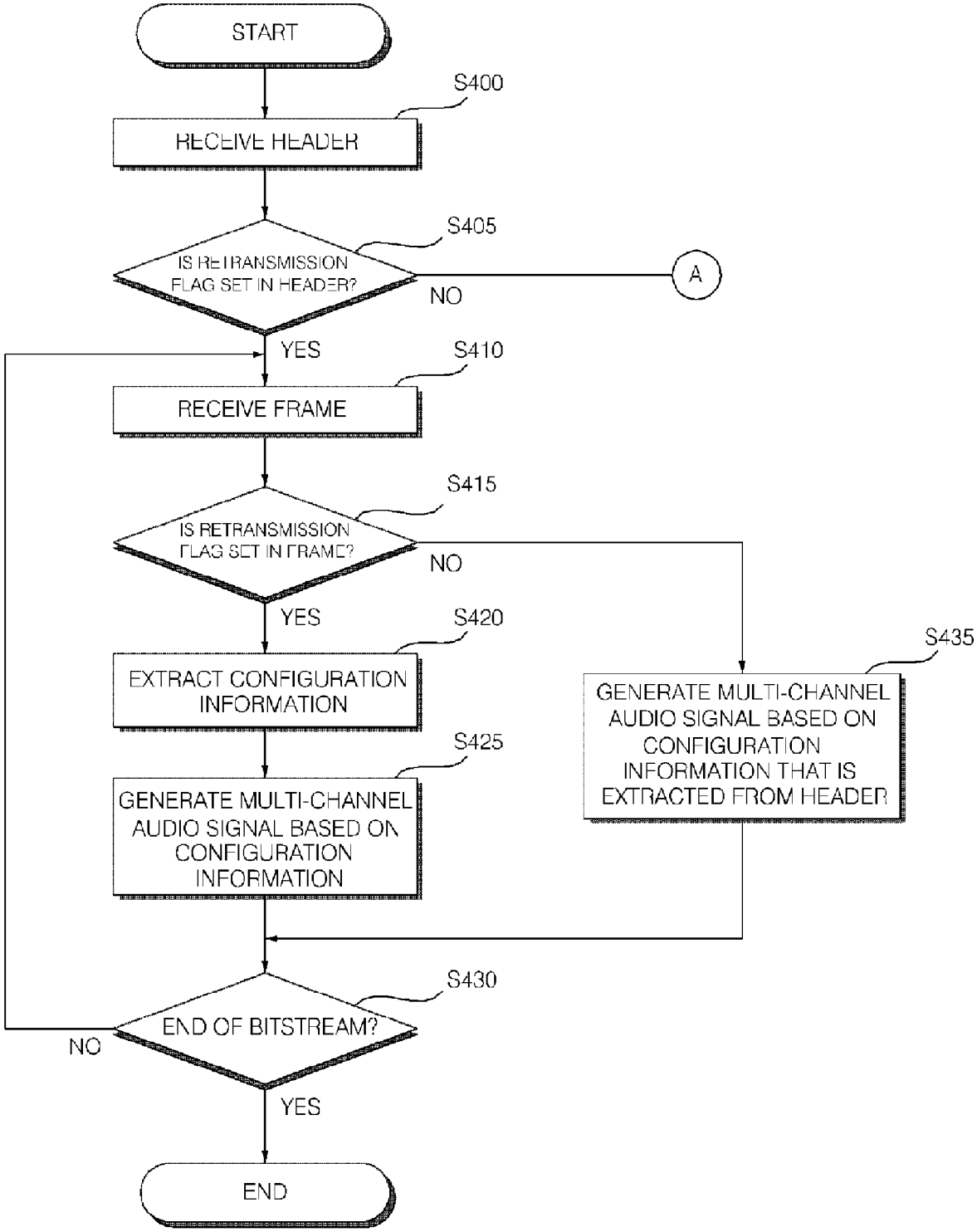

[Fig. 6]
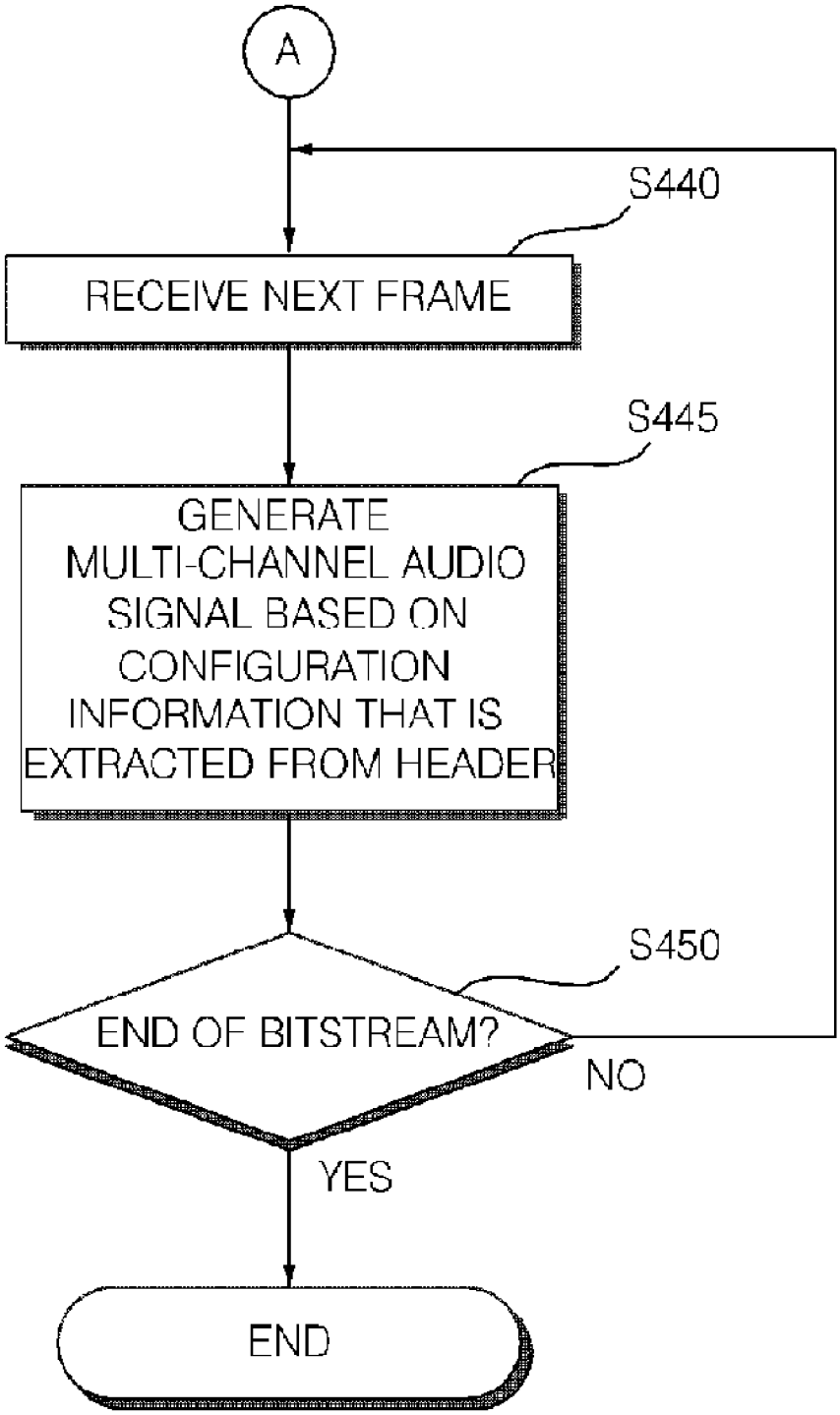

[Fig. 7]
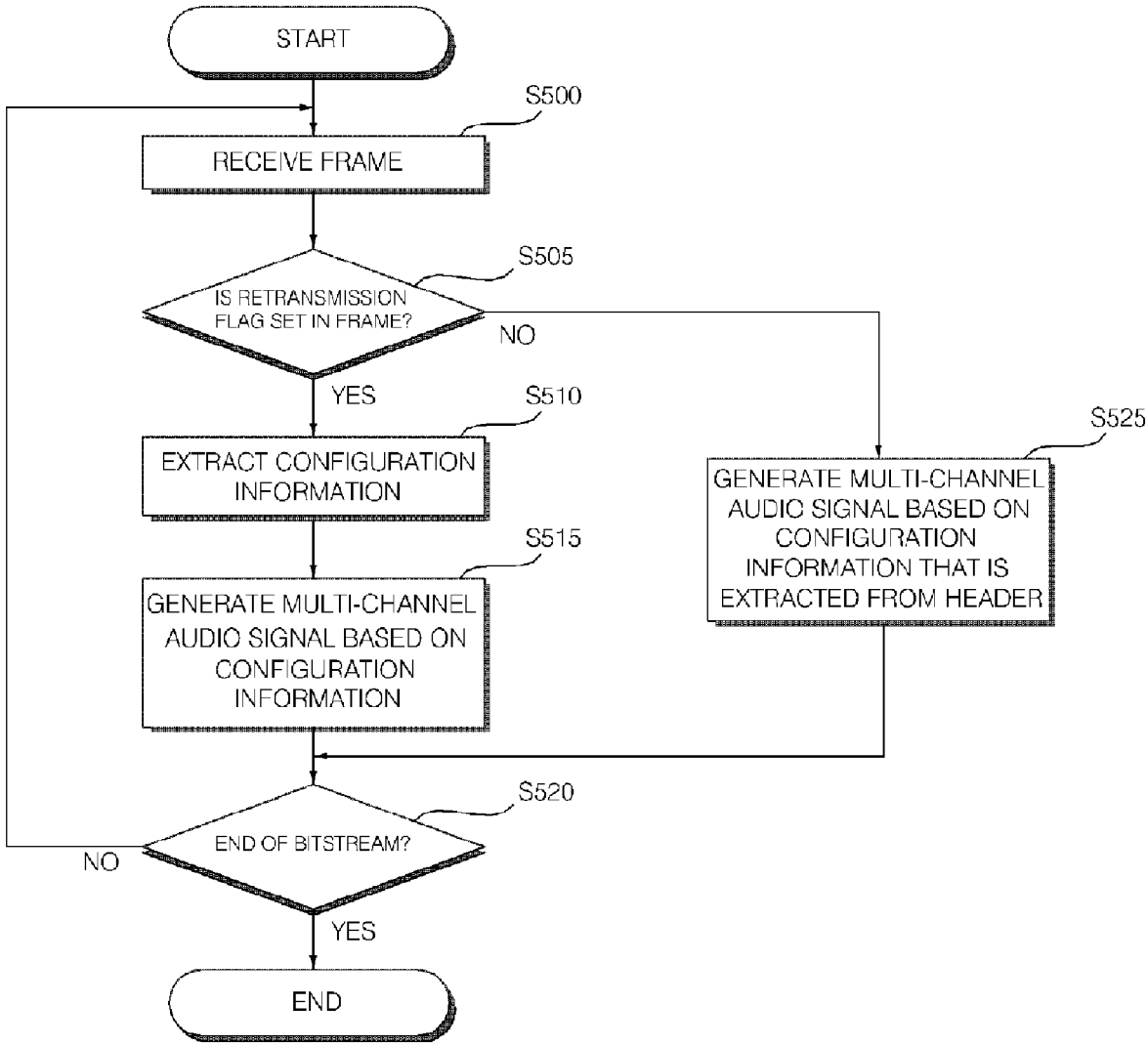

METHOD FOR ENCODING AND DECODING MULTI-CHANNEL AUDIO SIGNAL AND APPARATUS THEREOF

TECHNICAL FIELD

The present invention relates to an encoding method and apparatus and a decoding method and apparatus, and more particularly, to an encoding method and apparatus and a decoding method and apparatus in which a multi-channel audio signal is encoded or decoded so that all or part of information included in a header can be retransmitted.

BACKGROUND ART

In a typical method of encoding a multi-channel audio signal, a multi-channel audio signal is downmixed into a mono or stereo signal and the mono or stereo signal is encoded, instead of encoding each channel of the multi-channel audio signal. In this method, a multi-channel audio signal is encoded together with spatial information indicating spatial cues.

FIG. 1 is a diagram for illustrating a bitstream of a multi-channel audio signal generated using a typical method of encoding a multi-channel audio signal. Referring to FIG. 1, a bitstream of a multi-channel audio signal is divided into one or more frames (i.e., frames 1 through 3), and is thus transmitted or decoded in units of the frames. A header is placed ahead of frame 1. The header includes Spatial Audio Coding (SAC) configuration information, and each of frames 1 through 3 includes spatial information of a corresponding frame. The SAC configuration information comprises information that can be commonly applied to frames 1 through 3, i.e., sampling frequency information, frame length information, and tree configuration information specifying a downmix combination of a multi-channel signal.

Conventionally, SAC configuration information is included only in the header of a bitstream. Thus, when the header of a bitstream of a multi-channel audio signal is not received as in a streaming service, information needed to decode the bitstream cannot be obtained.

In addition, since tree configuration information is included only in SAC configuration information, the same downmix combination must be used throughout an entire multi-channel audio signal. Accordingly, it is impossible to perform decoding such that a downmix combination can vary from one frame to another of a multi-channel audio signal obtained by the decoding. Also, it is impossible to perform encoding/decoding such that each frame of a multi-channel audio signal can be encoded/decoded with optimum efficiency.

DISCLOSURE OF INVENTION

Technical Problem

The present invention provides an encoding method and apparatus in which information that is selected from a header can be retransmitted as additional configuration information.

The present invention also provides a decoding method and apparatus in which a bitstream including additional configuration information that is selected from a header can be decoded.

Technical Solution

According to an aspect of the present invention, there is provided an encoding method. The encoding method includes encoding spatial information that is calculated based on a multi-channel audio signal and a downmix signal, generating additional configuration information based on information that is selected from the encoded spatial information, encoding the downmix signal, generating a bitstream by combining the encoded downmix signal with the encoded spatial information, and inserting the additional configuration information into the bitstream.

According to another aspect of the present invention, there is provided an encoding apparatus. The encoding apparatus includes a downmix unit which generates a down-mix signal based on a multi-channel audio signal, a core encoder which encodes the down-mix signal, a spatial information generation unit which calculates spatial information of the multi-channel audio signal, a parameter encoder which encodes the spatial information, and a bitstream generation unit which generates a bitstream by combining the encoded spatial information and the encoded down-mix signal and inserts additional configuration information that is selected from the encoded spatial information into the bitstream.

According to another aspect of the present invention, there is provided a decoding method. The decoding method includes demultiplexing an encoded down-mix signal and additional information from a current frame of an input bitstream, determining whether additional configuration information has been retransmitted based on the additional information, and generating a multi-channel audio signal corresponding to the current frame based on the additional configuration information if the additional configuration information is determined to have been retransmitted.

According to another aspect of the present invention, there is provided a decoding apparatus. The decoding apparatus includes a demultiplexer which demultiplexes an encoded down-mix signal and additional information from a current frame of an input bitstream, a core decoder which generates a down-mix signal by decoding the encoded down-mix signal, a parameter decoder which determines whether additional configuration information has been retransmitted based on the additional information, and generates spatial information by encoding the additional configuration information if the additional configuration information is determined to have been retransmitted, and a multi-channel synthesization unit which generates a multi-channel audio signal based on the spatial information and the down-mix signal.

According to another aspect of the present invention, there is provided a computer-readable recording medium having recorded thereon a program for executing an encoding method, the encoding method including encoding spatial information that is calculated based on a multi-channel audio signal and a downmix signal; generating additional configuration information based on information that is selected from the encoded spatial information; and encoding the downmix signal, generating a bitstream by combining the encoded downmix signal with the encoded spatial information, and inserting the additional configuration information into the bitstream.

According to another aspect of the present invention, there is provided a computer-readable recording medium having recorded thereon a program for executing a decoding method, the decoding method including demultiplexing an encoded down-mix signal and additional information from a current frame of an input bitstream; determining whether additional configuration information has been retransmitted based on the additional information; and generating a multi-channel audio signal corresponding to the current frame based on the additional configuration information if the additional configuration information is determined to have been retransmitted.

Advantageous Effects

In the encoding method, spatial information that is calculated based on a multi-channel audio signal and a downmix signal is encoded, and additional configuration information is generated based on information that is selected from the encoded spatial information. The downmix signal is encoded, and then, a bitstream is generated by combining the encoded downmix signal with the encoded spatial information. Thereafter, the additional configuration information is inserted into the bitstream. Therefore, it is possible to configure an optimum bitstream according to the circumstances by retransmitting all or part of information included in a header.

BRIEF DESCRIPTION OF THE DRAWINGS

The above and other features and advantages of the present invention will become more apparent by describing in detail exemplary embodiments thereof with reference to the attached drawings in which:

FIG. 1 is a diagram for illustrating a bitstream of a typical multi-channel audio signal;

FIG. 2 is a block diagram of a system for encoding/decoding a multi-channel audio signal to which encoding and decoding methods according to an embodiment of the present invention are applied; and FIGS. 3 and 4 present syntax of spatial information used in the present invention;

FIGS. 5 and 6 are flowcharts illustrating a decoding method according to an embodiment of the present invention; and FIG. 7 is a flowchart illustrating a decoding method according to another embodiment of the present invention.

BEST MODE FOR CARRYING OUT THE INVENTION

The present invention will now be described more fully with reference to the accompanying drawings in which exemplary embodiments of the invention are shown.

Methods and apparatuses for encoding and decoding a multi-channel audio signal according to the present invention can be applied to the processing of a multi-channel audio signal. However, the present invention is not restricted thereto. In other words, the present invention can also be applied to the processing of a signal other than a multi-channel audio signal.

FIG. 2 is a block diagram of a system for encoding/decoding a multi-channel audio signal to which encoding and decoding methods according to an embodiment of the present invention are applied. Referring to FIG. 2, an encoding apparatus 100 includes a downmix unit 110, a spatial information generation unit 120, a core encoder 130, a parameter encoder 135, and a bitstream generation unit 140. A decoding apparatus 200 includes a demultiplexer 210, a core decoder 220, a parameter decoder 230, and a multi-channel synthesization unit 240.

The downmix unit 110 generates a downmix signal by downmixing a multi-channel audio signals comprising n channels into a mono or stereo signal. The encoding apparatus 100 may use an artistic downmix signal that is processed externally, instead of generating a downmix signal. The spatial information generation unit 120 calculates spatial information regarding a multi-channel audio signal. The core encoder 130 encodes the downmix signal generated by the downmix unit 110. The parameter encoder 135 encodes the spatial information obtained by the spatial information generation unit 120.

The bitstream generation unit 140 generates a bitstream by combining the encoded downmix signal and the encoded spatial information. The bitstream generation unit 140 may insert additional configuration information, if necessary, into the bitstream. The additional configuration information corresponds to all or part of spatial information or other information included in the header of the bitstream. In short, spatial information and additional configuration information can be included in a bitstream generated by the bitstream generation unit 140.

The demultiplexer 210 receives a bitstream input to the decoding apparatus 200, and demultiplexes an encoded downmix signal and encoded additional information from the received bitstream. The core decoder 220 generates a downmix signal by decoding the encoded downmix signal. The parameter decoder 230 generates spatial information by decoding the encoded additional information. If the encoded additional information comprises additional configuration information, the parameter decoder 230 may generate spatial information based on the additional configuration information. The multi-channel synthesization unit 240 generates a multi-channel audio signal based on the spatial information generated by the multi-channel synthesization unit 240 and the downmix signal generated by the core decoder 220.

FIGS. 3 and 4 present syntax of spatial information used in the present invention. Referring to FIG. 3, SpatialSpecificConfig( ) indicates spatial information included in a header. Referring to FIG. 4, SpatialFrame( ) indicates frame information which is information corresponding to each frame.

SpatialSpecificConfig( ) corresponds to SAC configuration information, and particularly, spatial information that can be commonly applied to a number of frames. SpatialSpecificConfig( ) comprises bsSamplingFrequency which indicates sampling frequency, bsFrameLength which indicates frame length, and bsTreeConfic which indicates information specifying a downmix combination of a multi-channel signal. SpatialFrame( ) comprises spatial information of each frame such as Framinginfo( ) which indicates time slot information in connection with the number of parameter sets.

According to the present embodiment, a multi-channel audio signal is encoded so that SpatialSpecficConfig( ), which corresponds to all or part of SAC configuration information, can be inserted into either a certain frame or each frame of the bitstream as additional configuration information. In other words, SAC configuration information can be inserted not only into a header of a bitstream but also into either a certain frame or each frame of the bitstream.

In order to decode a bitstream having additional configuration information inserted into a certain frame thereof, a multi-channel audio signal can be encoded in the following manner. First, in order to retransmit additional configuration information corresponding to SpatialSpecificConfig( ) to a certain frame, a retransmission flag (e.g., bsResendSptialSpecificConficFrame) indicating whether the additional configuration information has been retransmitted may be set in SpatialFrame( ). For example, if the retransmission flag bsResendSptialSpecificConficFrame is set in SpatialFrame( ), it may be determined, during the decoding of a bitstream, that additional configuration information corresponding to SpatialSpecifigConfig( ) is inserted into the bitstream.

Also, a retransmission flag bsResendSpatialSpecificConfigHeader may be set in SpatialSpecifigConfig( ), which is included into a header of a bitstream. If the retransmission flag bsResendSpatialSpecificConfigHeader is set, it may be determined again whether a retransmission flag bsResendSpatialSpecificConficFrame in SpatialFrame( ) is set, and additional configuration information may be received again according to the result of the determination. If the retransmission flag bsResendSpatialSpecificConfigHeader is not set, it means that a bitstream does not comprise any additional configuration information, and thus, the bitstream can be readily decoded without the need to reexamine the retransmission flag bsResendSpatialSpecificConficFrame.

Additional configuration information may be comprised of SpatialSpecificConfig( ) or may be comprised of a parameter set SpatialSpecificConfigParam that is selected from SpatialSpecificConfig( ). In this case, a retransmission flag bsResendSpatialSpecificConficParamFrame may be inserted into SpatialFrame( ). If the retransmission flag bsResendSpatialSpecificConficParamFrame is set, it may be determined that the parameter set SpatialSpecificConfigParam has been retransmitted. In addition, a re-transmission flag bsResendSpatialSpecificConfigParamHeader may be included in SpatialSpecifigConfig( ). If the retransmission flag bsResendSpatialSpecificConfigParamHeader is set, the retransmission flag bsResendSpatialSpecificConficParamFrame may be reexamined, and additional configuration information may be received again according to the results of the reexamination. On the other hand, if the retransmission flag bsResendSpatialSpecificConfigParamHeader is set, it may be determined that a bitstream does not comprise additional configuration information.

In this manner, it is possible to perform encoding so that all or part of spatial information included in a header of a bitstream can be retransmitted periodically or can be retransmitted, whenever necessary, by being carried on a frame that is selected from among a plurality of the bitstream.

The parameter set SpatialSpecificConfigParam, which corresponds to part of spatial information included in a header of a bitstream, may include at least one of a plurality of pieces of information included in SpatialSpecficConfig( ).

The definitions of the aforementioned variables in SpatialSpecConfig( ) are as presented in Table 1.

TABLE 1

| Variables | Definitions |
|---|---|
| bsSamplingFrequency | Define sampling frequency |
| bsFrameLength | Defines the number of time slots in a spatial frame |
| bsFreqRes | Defines the number of parameter bands |
| bsTreeConfig | Defines the tree configuration |
| bsQuantMode | Defines quantization and CLD energy-dependent quantization (EdQ) |
| bsOneIcc | Indicates if only a single ICC parameter subset is conveyed common to all OTT boxes. |
| bsArbitraryDowmix | Indicates the presence of arbitrary downmix gains |
| bsFixedGainsSur | Defines the gains used for the surround channels |
| bsFixedGainsLFE | Defines the gains used for the LFE channels |
| bsFixedGainsDMX | Defines the gains used for the downmix |
| bsMatrixMode | Indicates if a matrix compatible stereo downmix has been generated in the encoder |
| bsTempShapeConfig | Indicates operation mode of temporal shaping (TES and/or TP) in the decoder |
| bsDecorrConfig | Indicates operation mode of the decorrelator in the decoder |
| bs3DaudioMode | Indicates that the stereo downmix was 3D audio encoded and that inverse HRTF processing is to be applied |
| bsEnvQuantMode | Defines the quantization mode of the envelope shaping data |
| bs3DaudioHRTFset | Indicates the set of HRTF parameters |

For example, in order to indicate whether bsTreeConfig, which indicates the tree configuration of a multi-channel audio signal, has been retransmitted, a retransmission flag bsResendTreeConfigFrame may be inserted into SpatialFrame( ). For example, if the retransmission flag bsResendTreeConfigFrame is set, it is determined that bsTreeConfig has been retransmitted. As described above, a retransmission flag bsResendTreeConfigHeader may be inserted into SpatialSpecifigConfigHeader. If the retransmission flag bsResendTreeConfigHeader is set, the retransmission flag bsResendTreeConfigFrame can be reexamined.

In this manner, it is possible to retransmit bsTreeConfig periodically or whenever necessary. In addition, it is possible to effectively store and transmit signals by setting bsTreeConfig differently for each frame. For example, assume that a multi-channel audio signal with five channels comprises a portion whose quality is maintained even after the multi-channel audio signal is downmixed mono and a portion that must be compressed as stereo. In this case, according to the prior art, the multi-channel audio signal must be encoded as stereo in order to maintain the quality of the multi-channel audio signal. On the other hand, according to the present invention, only portions of the multi-channel audio signal that need to be compressed as stereo can be selectively encoded as stereo. In addition, according to the present invention, the mode of encoding can be changed according to the type of signals during the encoding of signals as mono signals, thus obtaining signals with better quality than in the prior art at a given bitrate.

According to the present embodiment, bsTreeConfig can be divided into three bits, i.e., bsTreeExt, bsTreeCh, and bsTreeCfg, and bsTreeExt, bsTreeCh, and bsTreeCfg can be used, instead of retransmitting bsTreeConfig. In this case, if bsTreeExt=1 and bsTreeConfig=15, then TreeDescription may be received through extended signaling. If bsTreeExt=0 and bsTreeCh=0, a 515 format may be used. If bsTreeExt=0 and bsTesCh=1, a 525 format may be used. If bsTreeExt=0, bsTreeCh=0, and bsTreeCfg=0, a 5151 format may be used. If bsTreeExt=0, bsTreeCh=0, and bsTreeCfg=1, a 5152 format may be used. In this manner, it is possible to represent bsTreeConfig with only two bits and thus reduce the number of bits used.

FIGS. 5 and 6 are flowcharts illustrating a decoding method according to an embodiment of the present invention. Referring to FIG. 5, in operation S400, a header of an input bitstream is received. In operation S405, it is determined whether a retransmission flag (bsResendSpatialSpecificConfigHeader) in the header is set. If it is determined in operation S405 that the retransmission flag (bsResendSpatialSpecificConfigHeader) in the header is not set, it means that the header does not include any additional configuration information, and thus, a multi-channel audio signal is generated using configuration information included in the header as spatial information in operations S440 through S450 illustrated in FIG. 6.

On the other hand, if it is determined in operation S405 that the retransmission flag (bsResendSpatialSpecificConfigHeader) in the header is set, it means that additional configuration information has been retransmitted. Then, in operation S410, a frame (hereinafter referred to as the current frame) of the input bitstream is received. In operation S415, it is determined whether a retransmission flag (bsResendSpatialSpecificConficFrame) in the current frame is set. In operation S420, if it is determined in operation S415 that the retransmission flag (bsResendSpatialSpecificConficFrame) in the current frame is set, additional configuration information is extracted. The additional configuration information may be included in the current frame or a previous frame.

In operation S420, once the additional configuration information is extracted, a multi-channel audio signal is generated based on a downmix signal according to the additional configuration information. In detail, an encoded downmix signal and frame information are demultiplexed from the current frame, spatial information is generated based on the additional configuration information and the frame information, and a multi-channel audio signal is generated based on the spatial information and the encoded downmix signal. If the additional configuration information is part of the spatial information included in the header, other information that is needed to generate spatial information may be obtained from spatial information that is extracted from the header. Then, in operation S435, if it is determined in operation S415 that the retransmission flag (bsResendSpatialSpecificConficFrame) in the current frame is not set, a multi-channel audio signal is generated based on the configuration information included in the header. Operations S400 through S425, S435, and S440 through S450 are repeatedly performed until the end of the input bitstream is encountered.

FIG. 7 is a flowchart illustrating a decoding method according to another embodiment of the present invention. Referring to the decoding method illustrated in FIG. 7, a retransmission flag is included, not in a header but in a frame. Referring to FIG. 7, in operation S500, a frame of an input bitstream is received. In operation S505, it is determined whether a retransmission flag in the frame is set. In operation S510, if it is determined in operation S505 that the retransmission flag in the frame is set, additional configuration information is extracted (from the frame?). In operation S515, a multi-channel audio signal is generated based on the additional configuration information. In detail, spatial information is generated based on the additional configuration information and frame information, and then, a multi-channel audio signal is generated based on the spatial information and a downmix signal.

On the other hand, in operation S525, if it is determined in operation S505 that the retransmission flag in the frame is not set, spatial information is generated based on the frame information and configuration information that is extracted from a header of the input bitstream, and a multi-channel audio signal is generated based on the spatial information and the downmix signal.

According to the present embodiment, additional configuration information is inserted into a certain frame of a bitstream, thereby enabling the generation of a multi-channel audio signal even when the header of the bitstream is not received as in a streaming service.

The present invention can be realized as computer-readable code written on a computer-readable recording medium. The computer-readable recording medium may be any type of recording device in which data is stored in a computer-readable manner. Examples of the computer-readable recording medium include a ROM, a RAM, a CD-ROM, a magnetic tape, a floppy disc, an optical data storage, and a carrier wave (e.g., data transmission through the Internet). The computer-readable recording medium can be distributed over a plurality of computer systems connected to a network so that computer-readable code is written thereto and executed therefrom in a decentralized manner. Functional programs, code, and code segments needed for realizing the present invention can be easily construed by one of ordinary skill in the art.

According to the present invention, a multi-channel audio signal is encoded so that all or part of information included in a header can also be included in a predetermined frame. Thus, the present invention can be applied to streaming services. In addition, according to the present invention, a multi-channel audio signal is encoded or decoded so that configuration can vary from one frame to another. Thus, it is possible to generate an optimum bitstream according to the circumstances.

Moreover, according to the present invention, spatial information can be selectively transmitted only to a few frames. Thus, it is possible to effectively reduce the amount of data to be transmitted while maintaining the quality of signals.

The present invention can be applied to the encoding/decoding of a multi-channel audio signal and can enable retransmission of all or part of information included in a header.

While the present invention has been particularly shown and described with reference to exemplary embodiments thereof, it will be understood by those of ordinary skill in the art that various changes in form and details may be made therein without departing from the spirit and scope of the present invention as defined by the following claims.

INDUSTRIAL APPLICABILITY

The present invention is used to an encoding method and apparatus and a decoding method and apparatus in which a multi-channel audio signal is encoded or decoded so that all or part of information included in a header can be retransmitted.

The invention claimed is:

1. A method of decoding an audio signal performed by an audio coding system, comprising:

obtaining a frame of an audio signal including a downmix signal and spatial information, the downmix signal generated by downmixing a multi-channel audio signal, and the spatial information to be used in order to generate an output multi-channel audio signal from the downmix signal;

obtaining configuration information from the spatial information being included in the frame, the configuration information including tree configuration information indicating a tree configuration of the downmix signal to generate the output multi-channel audio signal, downmix gain information indicating a gain to be applied to the downmix signal, and channel gain information indicating at least one gain to be applied to at least one channel of the multi-channel audio signal;

determining the tree configuration based on the tree configuration information; and generating the output multi-channel audio signal by modifying a gain of the downmix signal and at least one channel of the multi-channel audio signal using the downmix gain information and the channel gain information, respectively, based on the determined tree configuration, wherein the number of channels of the output multi-channel audio signal is greater than the number of channels of the downmix signal.

2. The method of claim 1, wherein the configuration information is obtained based on a flag indicating whether the configuration information is included in the frame.

3. The method of claim 2, wherein the flag indicates whether the configuration information is retransmitted.

4. The method of claim 1, wherein the configuration information comprises parameter band number information, sampling frequency information, frame length information, decorrelation mode information, 3D audio mode information, quantization mode of envelope shaping data information and HRTF parameter information.

5. The method of claim 1, wherein the spatial information included OTT (One-to Two) data usable to upmix one channel into two channels, and TTT (Two-to-Three) data usable to upmix two channels into three channels.

6. An apparatus for decoding an audio signal, comprising:

a parameter decoder configured for decoding a bitstream being received from an encoding apparatus, the decoding the bitstream including:

obtaining a frame of an audio signal including a downmix signal and spatial information, the downmix signal generated by downmixing a multi-channel audio signal, and the spatial information to be used in order to generate an output multi-channel audio signal from the downmix signal; and obtaining configuration information from the spatial information being included in the frame, wherein the bitstream includes a downmix signal and wherein the configuration includes tree configuration information indicating a tree configuration of the downmix signal to generate the output multi-channel audio signal, downmix gain information indicating a gain to be applied to the downmix signal, and channel gain information indicating at least one gain to be applied to at least one channel of the multi-channel audio signal; and a multi-channel synthesization unit configured for determining the tree configuration based on the tree configuration information, and generating the output multi-channel audio signal by modifying a gain of the downmix signal and at least one channel of the multi-channel audio signal using the downmix gain information and the channel gain information, respectively, based on the determined tree configuration, wherein the number of channels of the output multi-channel audio signal is greater than the number of channels of the downmix signal.

7. The apparatus of claim 6, wherein the configuration information is obtained based on a flag indicating whether the configuration information is included in the frame.

8. The apparatus of claim 7, wherein the flag indicates whether the configuration information is retransmitted.

9. The apparatus of claim 6, wherein the configuration information comprises parameter band number information, sampling frequency information, frame length information, decorrelation mode information, 3D audio mode information, quantization mode of envelope shaping data information and HRTF parameter information.

10. The apparatus of claim 6, wherein the spatial information included OTT (One-to Two) data usable to upmix one channel into two channels, and TTT (Two-to-Three) data usable to upmix two channels into three channels.

11. A method of encoding an audio signal performed by an audio coding system, comprising:

generating a downmix signal by downmixing a multi-channel audio signal;

generating spatial information extracted when the downmix signal is generated, the spatial information being usable to generate an output multi-channel audio signal from the downmix signal;

generating configuration information including tree configuration information, downmix gain information and channel gain information, based on the downmix signal and the multi-channel audio signal, the tree configuration information indicating a tree configuration of the downmix signal to the multi-channel audio signal, the downmix gain information indicating a gain to be applied to the downmix signal, and the channel gain information indicating at least one gain to be applied to at least one channel of the multi-channel audio signal; and inserting the configuration information into a frame of a bitstream of an audio signal, the bitstream including the downmix signal, wherein the number of channels of the output multi-channel audio signal is greater than the number of channels of the downmix signal.

12. An apparatus for encoding an audio signal, comprising:

a downmixing unit configured for generating a downmix signal by downmixing a multi-channel audio signal;

a spatial information generating unit generating spatial information extracted when the downmix signal is generated, the spatial information being used to generate an output multi-channel audio signal, the spatial information being usable to generate an output multi-channel audio signal from the downmix signal, the spatial information including configuration information including tree configuration information, downmix gain information and channel gain information; and a bitstream generating unit generating a bitstream by inserting the configuration information into a frame of a bitstream of an audio signal, the bitstream including the downmix signal, wherein the tree configuration information indicates a tree configuration of the downmix signal to the multi-channel audio signal, and the downmix gain information indicates a gain to be applied to the downmix signal, and the channel gain information indicates at least one gain to be applied to at least one channel of the multi-channel audio signal, wherein the number of channels of the output multi-channel audio signal is greater than the number of channels of the downmix signal.

* * * * *